US008453389B2

(12) United States Patent
Selke et al.

(10) Patent No.: US 8,453,389 B2
(45) Date of Patent: Jun. 4, 2013

(54) ROOF BOOT

(76) Inventors: Bruce A. Selke, Greenfield, IN (US); John A. Turner, Greenfield, IN (US); David A. Mitchell, Muncie, IN (US)

( * ) Notice: Subject to any disclaimer, the term of this patent is extended or adjusted under 35 U.S.C. 154(b) by 0 days.

(21) Appl. No.: 13/198,026

(22) Filed: Aug. 4, 2011

(65) Prior Publication Data

US 2012/0031024 A1 Feb. 9, 2012

Related U.S. Application Data

(60) Provisional application No. 61/370,647, filed on Aug. 4, 2010.

(51) Int. Cl.
*E04D 13/14* (2006.01)

(52) U.S. Cl.
USPC ..... 52/58

(58) Field of Classification Search
USPC ..... 52/219, 198, 199; 285/42
See application file for complete search history.

(56) References Cited

U.S. PATENT DOCUMENTS 1,258,884 A * 3/1918 Fife ..... 285/4
1,282,535 A * 10/1918 Bropson ..... 285/44
1,287,235 A * 12/1918 Cole ..... 285/44
1,686,881 A * 10/1928 Stephenson ..... 285/43
2,510,926 A * 6/1950 Goldstein ..... 285/43
3,087,745 A * 4/1963 Rumbell ..... 285/222.1
3,098,663 A * 7/1963 Dibley ..... 285/43
RE26,026 E * 5/1966 Dibley ..... 285/43
3,313,559 A * 4/1967 Kifer ..... 285/43
3,398,671 A * 8/1968 Acosta ..... 454/36
3,731,952 A * 5/1973 Elwart ..... 285/3
3,797,181 A * 3/1974 Nievelt ..... 52/105
3,977,137 A * 8/1976 Patry ..... 52/60
4,010,578 A * 3/1977 Logsdon ..... 52/58
4,120,129 A 10/1978 Nagler et al.
4,211,423 A * 7/1980 Resech ..... 277/636
4,265,058 A * 5/1981 Logsdon ..... 52/58
4,333,660 A * 6/1982 Cupit ..... 277/630
4,512,119 A * 4/1985 Willoughby ..... 52/58
4,526,407 A * 7/1985 Kifer ..... 285/42
4,563,847 A * 1/1986 Hasty ..... 52/219
4,570,943 A * 2/1986 Houseman et al. ..... 277/606
4,768,812 A * 9/1988 Katz ..... 285/43
4,864,782 A * 9/1989 Hasty ..... 52/60
4,903,997 A * 2/1990 Kifer ..... 285/43
5,005,328 A 4/1991 Holtgreve
5,018,748 A * 5/1991 Schalle ..... 277/641
5,036,636 A * 8/1991 Hasty ..... 52/100
5,176,408 A * 1/1993 Pedersen ..... 285/42
5,222,334 A * 6/1993 Hasty ..... 52/100
5,226,263 A * 7/1993 Merrin et al. ..... 52/58
5,347,776 A * 9/1994 Skoff ..... 52/219

(Continued)

*Primary Examiner* — Mark Wendell
*Assistant Examiner* — Keith Minter
(74) *Attorney, Agent, or Firm* — Woodard, Emhardt, Moriarty, McNett & Henry LLP

(57) ABSTRACT

A flashing for sealing around a pipe or conduit includes a dome portion with an opening with an inwardly extending lip, and a replaceable seal sized to fit in the dome opening so as to seal around a vent pipe. The seal includes a downwardly extending locking member to grip and lock the inwardly extending lip of the dome portion. The flashing may include a flange portion to facilitate installing the flashing on a roof. Once installed, the replaceable seal may be replaced without replacing the entire flashing, yet securely grips to the base of the flashing.

6 Claims, 4 Drawing Sheets

U.S. PATENT DOCUMENTS 5,588,267 A * 12/1996 Rodriguez et al. ..... 52/219
5,703,154 A * 12/1997 Davis et al. ..... 524/525
5,860,256 A * 1/1999 Humber ..... 52/219
6,122,870 A * 9/2000 Marcum ..... 52/219
6,219,977 B1 * 4/2001 Chao et al. ..... 52/200
6,279,272 B1 * 8/2001 Nill, Jr. ..... 52/58
6,691,469 B2 2/2004 Miller
6,691,473 B1 2/2004 Mayle et al.
6,792,726 B1 * 9/2004 Price ..... 52/220.8
6,892,499 B1 5/2005 Mayle
6,997,801 B1 2/2006 Green
7,114,301 B2 * 10/2006 Bibaud et al. ..... 52/219
7,168,211 B2 * 1/2007 Prenn et al. ..... 52/200
7,814,709 B1 * 10/2010 Resech ..... 52/58
2004/0255523 A1 * 12/2004 Bibaud et al. ..... 52/58
2006/0130411 A1 * 6/2006 Edgar et al. ..... 52/58
2008/0098673 A1 * 5/2008 Johnston et al. ..... 52/198

* cited by examiner

ROOF BOOT

CROSS-REFERENCE TO RELATED APPLICATIONS

This application claims the benefit of U.S. Provisional Application No. 61/370,647, filed Aug. 4, 2010, which is hereby incorporated by reference.

BACKGROUND TO THE INVENTION

Roof vent pipes typically are sealed by flashing around the pipe where the pipe passes through the roofing material. Over time, the flashing can deteriorate and water may begin to leak in to the roof at that point. Replacing the flashing typically involves removing the old flashing and replacing it with new flashing. To do that, at least some of the roofing shingles must be removed. Those shingles tear and must be replaced. Perfect matches for the old shingles may not be available, and the cost to replace the shingles and associated flashing is in the hundreds of dollars.

To solve that problem, one option is to install a system that uses replaceable collars that fit around the vent pipe. When the old collar deteriorates, a new collar is placed over the vent pipe and pushed down over the old collar. The collars simply stack up as they are replaced, and provide a reasonable seal around the pipe. Unfortunately, to the extent the collar does not lock into sound roof flashing, leakage may continue to occur at the base of the collar if it is not glued or otherwise secured firmly in place.

A need therefore exists for a device and method for replacing deteriorated roof flashing around a vent pipe. The present invention addresses that need.

SUMMARY OF THE INVENTION

In one aspect of the present invention there is provided a flashing for sealing around a pipe or conduit. The flashing includes:

a) a base member having a lower flange portion and an upper dome portion, said dome portion having an opening with an inwardly extending lip; and b) a replaceable seal sized to fit in said dome opening and effective to seal around a vent pipe positioned in said opening. The seal includes a sealing member effective for sealing around a vent pipe to direct water away from the pipe, and a locking member extending downward from the sealing member and effective to grip and lock the inwardly extending lip of the dome portion.

In another aspect of the present invention there is provided a flashing for retrofit installation around a pipe or conduit, comprising:

a) a dome member having an opening with an inwardly extending lip; and b) a replaceable seal sized to fit in said dome opening and effective to seal around a vent pipe positioned in said opening, said seal including a sealing member effective for sealing around a vent pipe to direct water away from the pipe, and a locking member extending downward from the sealing member and effective to grip and lock the inwardly extending lip of the dome portion.

DESCRIPTION OF PREFERRED EMBODIMENTS

Figure 1:
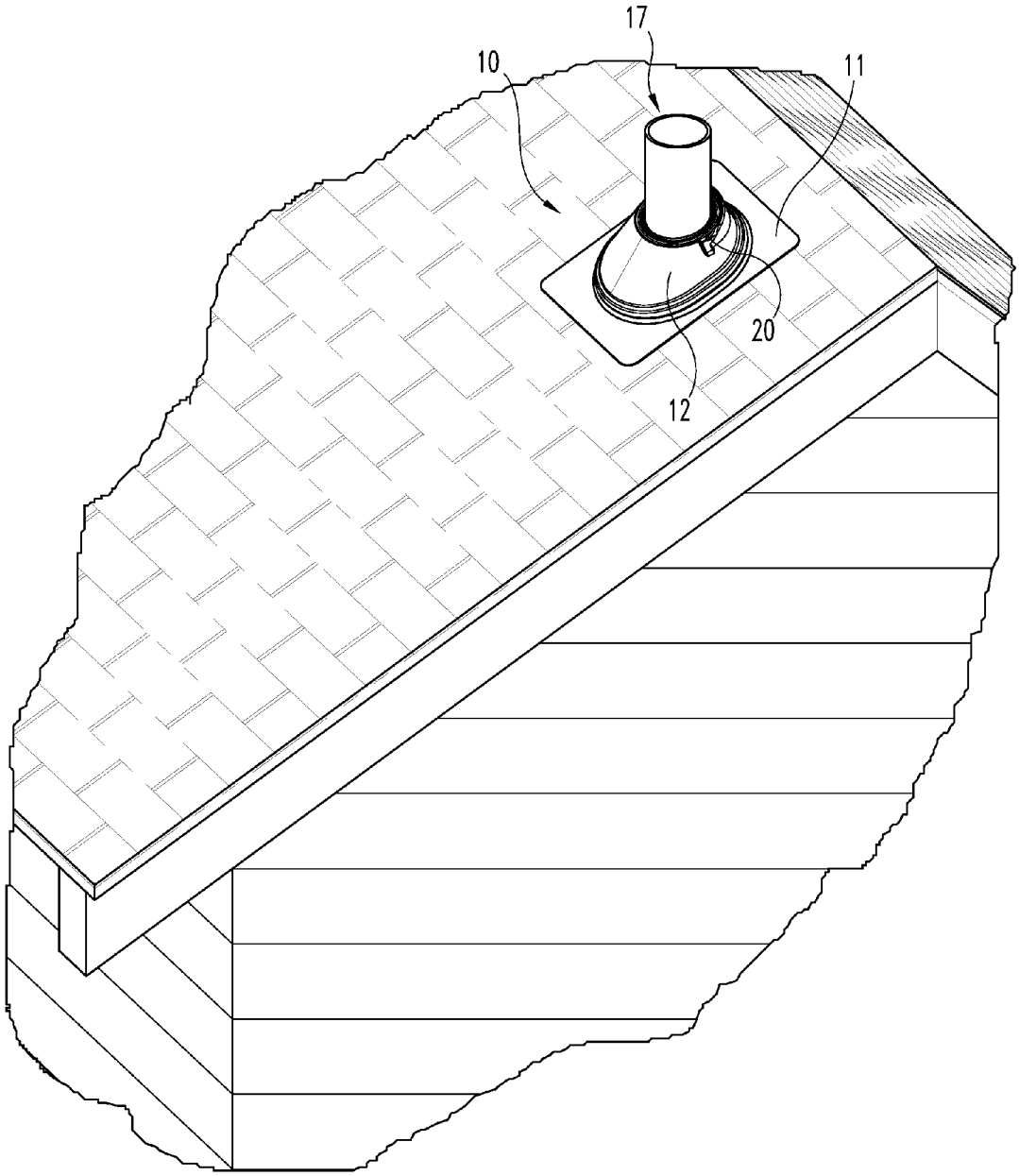
FIG. 1 shows the inventive device according to one preferred embodiment.

For the purposes of promoting an understanding of the principles of the invention, reference is made herein to certain preferred embodiments and specific language will be used to describe the same. It will nevertheless be understood that no limitation of the scope of the invention is thereby intended, with such alterations and further modifications in the illustrated invention, and such further applications of the principles of the invention as illustrated therein, being contemplated as would normally occur to one skilled in the art to which the invention relates.

One aspect of the present invention relates to a flashing for use in new construction to seal around a pipe or conduit. The flashing preferably includes a base member with a lower flange portion and an upper dome portion. The dome portion preferably has an opening at its upper end, with an inwardly extending lip. The flashing also preferably includes a replaceable seal sized to fit in the dome opening and effective to seal around a vent pipe to prevent water from entering the roof immediately adjacent the vent pipe. The seal preferably includes a downwardly extending locking member to grip and lock the inwardly extending lip of said dome portion.

More particularly describing one embodiment of the base member of the present invention, when intended for use in new building construction the base member preferably includes a lower flange portion that lays flat on the roofing material above or below or sandwiched between the shingles. The flange portion is sized to provide good overlap with the roofing material around the vent pipe or other structure being protected. A size of about 12" to about 16" is appropriate for many home installations.

The base member also preferably includes an upper dome portion that extends upward from the lower flange portion to surround the vent pipe or other structure being protected. The fit around the pipe need not be snug, and is preferably not snug in some embodiments.

The upper end of the dome portion includes an opening sized to allow a vent pipe of other structure to pass therethrough. The opening is typically sized to provide a modest (½" to 2") gap around the vent pipe when the seal is not in place.

The upper end of the dome portion may be generally flat, to accommodate an annular seal. This upper part preferably extends inward to the opening for a distance sufficient to hold and support the seal. In some embodiments the flat portion extends inward for a distance of about ½" to 1" or so.

The upper flat portion provides a lip that may cooperate with the seal to grip and hold the seal in a waterproof connection.

The base member may be made of a rigid material such as ABS plastic or polypropylene. Sufficient stiffness is desired to allow the lip to secure a seal when the seal grips the lip. UV inhibitors may be included in the material.

A replaceable seal is preferably provided to fit in the dome opening. The replaceable seal should be effective to prevent water from seeping into the roofing material in the area immediately adjacent the vent pipe. The seal is replaceable by being releasably attachable to the base member, so that the seal can be replaced without replacing the base member.

The seal may include a downwardly extending locking member to grip and lock the inwardly extending lip of the dome portion of the base member. Other means for releasably attaching the replaceable seal to the base member may alternatively or additionally be provided.

The upper portion of the seal extends over the downwardly extending locking member in both radial directions (i.e., toward the vent pipe and away from the vent pipe) to prevent water from leaking into the area between the seal and the base member, and particularly between the locking member and the dome lip. In some embodiments the upper portion of the annular seal extends between about 0.5" and 1.5" in each direction.

In some embodiments the upper part of the dome portion includes a channel for directing water away from the seal. The channel is preferably about ¼" to 1" wide and about ¼" to ½" deep, and may extend all or part of the way around the top of the dome member.

In other embodiments the upper part of the dome portion includes a blocking member extending upward adjacent and above at least a portion of said seal to block ice and debris from dislodging the seal. The blocking member is preferably about ¼" to 1" wide and about ¼" to 1" tall, and may extend all or part of the way around the top of the dome member.

Another aspect of the present invention relates to a flashing for retrofit use to repair deteriorated flashing around a pipe or conduit. The retrofit flashing preferably includes a dome member having an opening with an inwardly extending lip, and a seal sized to fit in the dome opening and to seal around a vent pipe.

The "retrofit flashing" embodiment differs from the "original construction" embodiment primarily by not having a flange member for attachment to the roofing material. Instead, the dome portion simply fits over a dome portion of an existing roof flashing, such as an Oatey 3"-4" All-Flash Thermoplastic Rood Flashing.

As with "original construction" embodiment, the dome portion of the "retrofit flashing" embodiment preferably includes an opening at to receive a vent pipe, with an inwardly extending lip. As with "original construction" embodiment, the "retrofit flashing" also preferably includes a replaceable seal sized to fit in the dome opening and effective to seal around a vent pipe to prevent water from entering the roof immediately adjacent the vent pipe. The seal preferably includes a downwardly extending locking member to grip and lock the inwardly extending lip of said dome portion. The details and features of the dome portion and the replaceable seal are generally as described above.

Referring now top the drawings, FIG. 1 shows the inventive device according to one preferred embodiment. The illustrated device includes a base member 10 with a flange portion 11 and a dome portion 12. Replaceable seal 20 seals around vent pipe 17 to prevent water from leaking in around the pipe. The replaceable seal may be replaced without removing the base member from the roofing.

Figure 2:
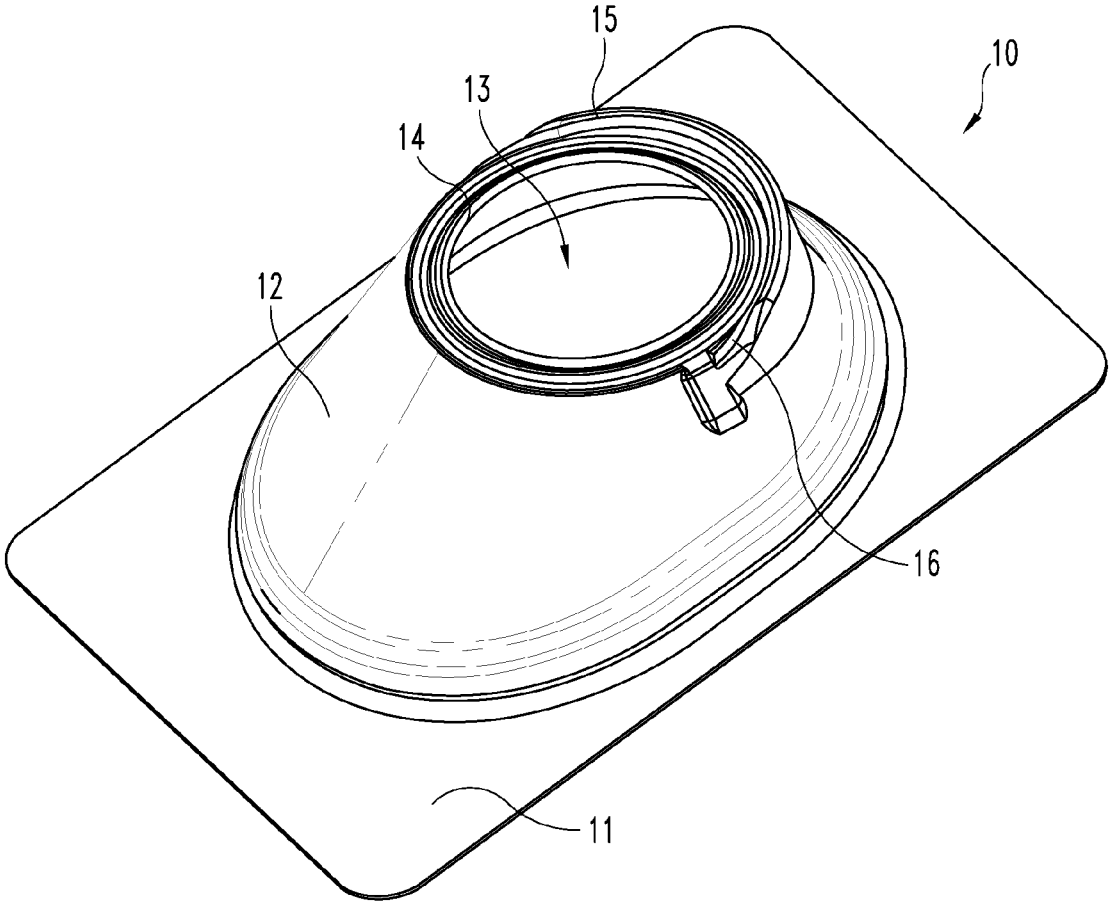
FIG. 2 shows a base member for use in the inventive device, according to one preferred embodiment.

FIG. 2 shows a base member for use in the inventive device, according to one preferred embodiment. Base member 10 includes a flange portion 11 having a dome portion 12. An upper opening 13 is provided in the top of dome portion 12. An inwardly extending lip 14 is provided around opening 13. Lip 14 provides a way for a replaceable seal to grip and attach to the dome portion of the device.

A blocking member 15 extends upward adjacent and above the rear portion of dome portion 12 to block ice and debris from dislodging the seal. The illustrated blocking member is about ½" wide and about ¾" tall.

A channel 16 is provided at the rear of the top surface of dome portion 12. Channel 16 is effective for directing water away from the seal. The illustrated channel is about ½" wide and ¼" deep.

Figure 3:
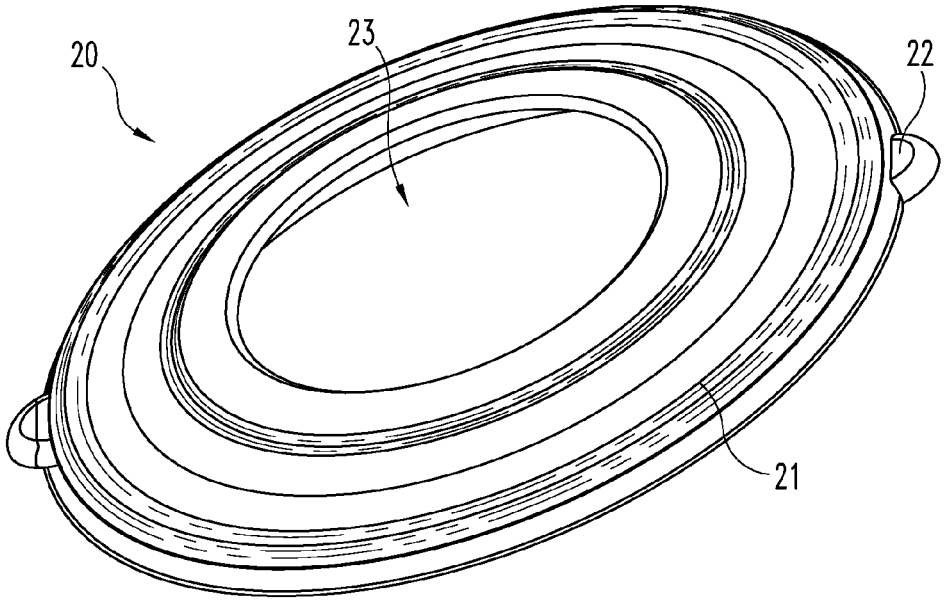
FIG. 3 shows a replaceable seal for use in the inventive device, according to one preferred embodiment.
Figure 4:
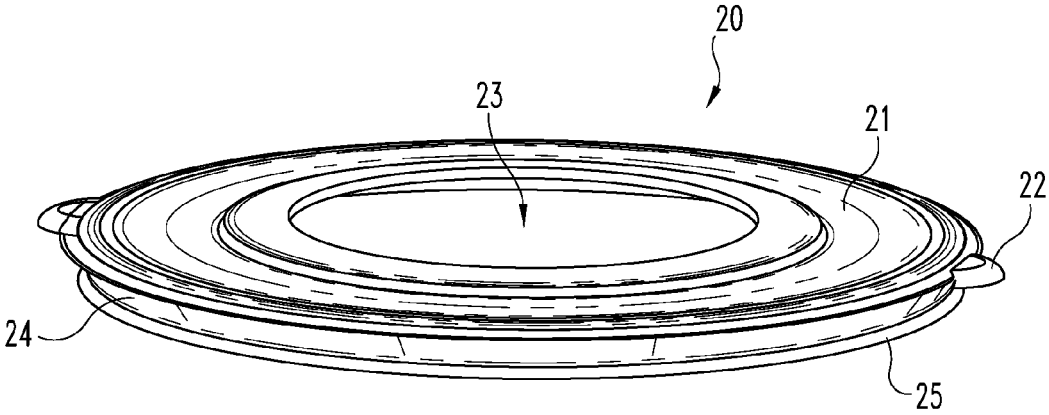
FIG. 4 is another view of a replaceable seal for use in the inventive device, according to one preferred embodiment.

FIGS. 3 and 4 show a replaceable seal for use in the inventive device. Seal 20 includes a sealing member 21 and an opening 23 into which a vent pipe may be positioned. A locking member 24 extends downward from sealing member 21 and is effective for gripping the inwardly extending lip 14 of dome portion 12. A tab 22 may be provided to facilitate maneuvering the seal.

Locking member 24 extends downward from the upper surface of sealing member 21, and includes an outwardly-extending seal lip 25 for gripping inwardly-extending dome opening lip 14. Locking member 24 therefore provides a groove sized to receive and releasably grip dome opening lip 14 to hold seal 20 in position around the perimeter of dome opening 13, thus allowing the releasable seal to quickly and easily be snapped into and out of base member 10.

Figure 5:
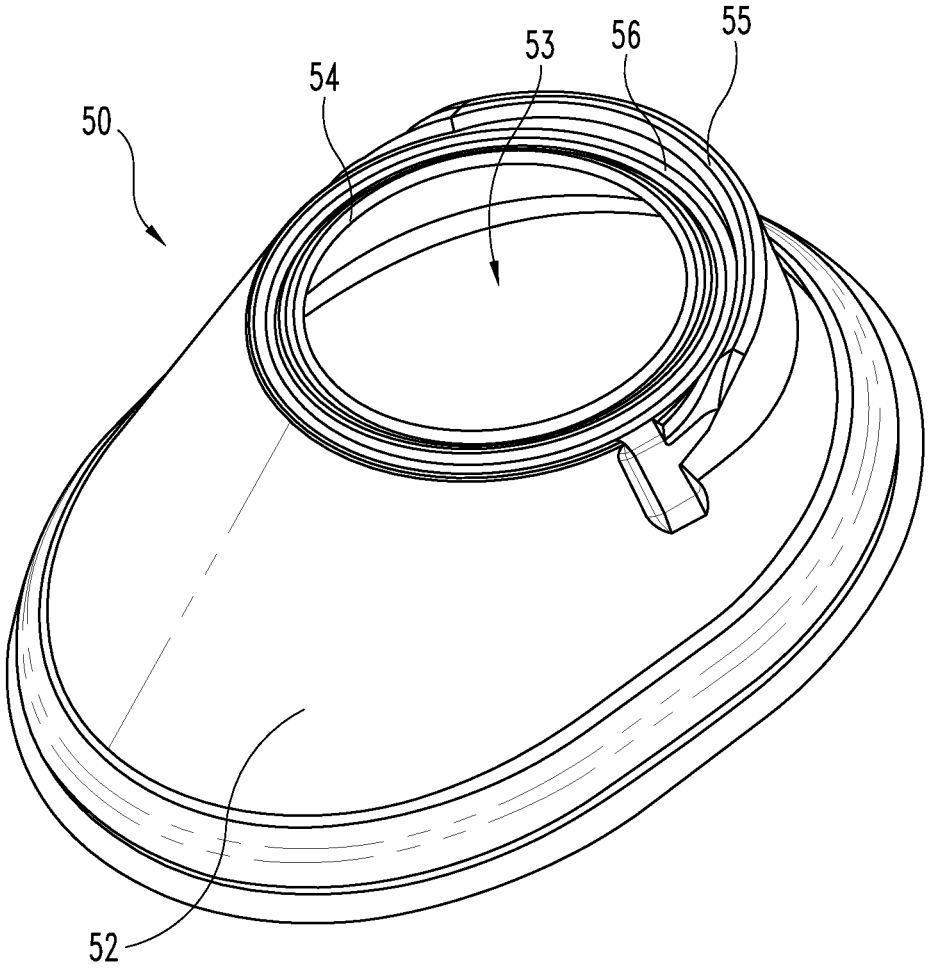
FIG. 5 shows another embodiment of a base member for use in the inventive device.

FIG. 5 shows another embodiment of a base member for use in the inventive device. In this embodiment, the device is intended to be retrofit over a pre-existing flashing and therefore does not include a base flange. The illustrated devices does, however, include a dome portion 52, an upper opening 53 at the top of dome portion 52, and an inwardly extending lip 54 around opening 53. As in the earlier described embodiment, lip 54 provides a way for a replaceable seal to grip and attach to the dome portion of the device.

A blocking member 55 extends upward adjacent and above the rear portion of dome portion 52 to block ice and debris from dislodging the seal. A channel 56 is provided at the rear of the top surface of dome portion 52 to direct water away from the seal.

To use the "original construction" embodiment, the flange portion of the flashing may be nailed to the roof deck before or after the shingles are installed. The dome portion of the device extends upward around a vent pipe with a small gap between the pipe and the perimeter of the dome opening. The sealing member may be pushed down over the pipe until it snaps into the dome opening, with the locking member extending downward to the inwardly-extending seal lip that grips the dome opening lip.

If and when the seal deteriorates, it may be replaces without replacing the entire flashing. Instead, it is possible to replace only the seal portion by removing the old seal portion and snapping a new seal portion in place. Alternatively, a "retrofit" flashing may be installed by sliding a new dome portion over an old dome portion, with the new dome portion including a new seal.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A flashing for sealing around a pipe or conduit, comprising:

a) a base member having a lower flange portion and an upper dome portion, said dome portion having an opening with an inwardly extending dome opening lip; and b) a replaceable seal sized to fit in said dome opening and removable from said dome opening, effective to seal around a vent pipe positioned in said opening, said replaceable seal including an upper surface effective for around a vent pipe to direct water away from the pipe, and a seal locking member extending downward from the upper surface and comprising an outwardly-extending lip that cooperates with the upper surface of the sealing member to form a groove effective to receive and releasably engage the inwardly extending dome opening lip to grip and releasably hold the replaceable seal in the base member.

2. A flashing according to claim 1 wherein said dome member includes a channel for directing water away from the seal.

3. A flashing according to claim 1 wherein said dome member includes a blocking member extending upward adjacent and above at least a portion of said seal to block ice and debris from dislodging the seal.

4. A flashing for sealing around a pipe or conduit, comprising:

a) a dome member having an opening with an inwardly extending lip; and b) a replaceable seal sized to fit in said dome opening and removable from said dome opening, and effective to seal around a vent pipe positioned in said opening, said seal including an upper surface effective for sealing around a vent pipe to direct water away from the pipe, and a seal locking member extending downward from the upper surface and comprising an outwardly-extending lip that cooperates with the upper surface of the sealing member to form a groove effective to receive and releasably engage the inwardly extending dome opening lip to grip and releasably hold the replaceable seal in the base member.

5. A flashing according to claim 4 wherein said dome member includes a channel for directing water away from the seal.

6. A flashing according to claim 4 wherein said dome member includes a blocking member extending upward adjacent and above at least a portion of said seal to block ice and debris from dislodging the seal.

* * * * *